US005960980A

United States Patent [19]

Burke et al.

[11] Patent Number: 5,960,980

[45] Date of Patent: Oct. 5, 1999

[54] VENTED HATCH COVER

[75] Inventors: Michael K. Burke, Wheaton; John D. Anderson; Walter J. Peach, Jr., both of Aurora, all of Ill.

[73] Assignee: Zeftek, Inc., Montgomery, Ill.

[21] Appl. No.: 08/868,463

[22] Filed: Jun. 3, 1997

[51] Int. Cl.[6] ..... B65D 51/16; B61D 39/00

[52] U.S. Cl. ..... 220/325; 220/374; 220/844; 292/256.5; 277/645

[58] Field of Search ..... 220/314, 315, 220/324, 325, 343, 367.1, 373, 374, 371, 372, 803, 804, 327, 328, 844; 292/256.5, DIG. 49, DIG. 60; 70/461; 105/377; 277/645, 605

[56] References Cited

U.S. PATENT DOCUMENTS

| | | | |
|---|---|---|---|
| D. 340,207 | 10/1993 | Schultz . | |
| 418,867 | 1/1890 | Dundon . | |
| 1,266,926 | 5/1918 | Dundon . | |
| 2,324,356 | 7/1943 | Brown . | |
| 2,641,202 | 6/1953 | Talmey et al. . | |
| 2,825,276 | 3/1958 | Porter . | |
| 4,057,020 | 11/1977 | Halliar et al. . | |
| 4,127,216 | 11/1978 | Martin, Jr. et al. . | |
| 4,248,160 | 2/1981 | Carney, Jr. et al. . | |
| 4,315,579 | 2/1982 | Martin, Jr. et al. . | |
| 4,457,522 | 7/1984 | Trieste et al. | 277/645 X |
| 4,461,219 | 7/1984 | Bateson . | |
| 4,470,623 | 9/1984 | Judge, Jr. . | |
| 4,570,816 | 2/1986 | Ferris et al. . | |
| 4,573,717 | 3/1986 | Peacock . | |
| 4,609,126 | 9/1986 | Janda . | |
| 4,635,979 | 1/1987 | Blume . | |
| 4,644,874 | 2/1987 | Kleykamp . | |
| 4,655,365 | 4/1987 | Miller . | |
| 4,690,070 | 9/1987 | Miller . | |
| 4,693,393 | 9/1987 | DeMinco et al. | 220/374 |
| 4,819,830 | 4/1989 | Schultz . | |
| 4,889,056 | 12/1989 | Stewart . | |
| 4,902,173 | 2/1990 | Hendee et al. . | |
| 4,944,233 | 7/1990 | Dugge et al. . | |
| 5,064,089 | 11/1991 | Schultz . | |
| 5,158,022 | 10/1992 | Dugge et al. | 220/372 X |
| 5,438,935 | 8/1995 | Seitz | 220/324 X |
| 5,558,244 | 9/1996 | Akaike et al. | 220/374 |
| 5,622,117 | 4/1997 | Burian et al. . | |
| 5,644,990 | 7/1997 | Seitz . | |
| 5,738,396 | 4/1998 | Oestermeyer et al. | 292/256.5 |

OTHER PUBLICATIONS

Ad, Special Products Group, American Railcar Industries, *Railway Age*, Apr. 1997.

*Primary Examiner*—Stephen K. Cronin
*Assistant Examiner*—Nathan Newhouse
*Attorney, Agent, or Firm*—Lloyd L. Zickert

[57] ABSTRACT

A vented hatch cover assembly for a railroad hopper car including top and bottom members having substantially rigid and somewhat dome-shaped bodies which are divided into four quadrants wherein each quadrant includes coacting baffle members extending from the bodies of the top and bottom members which define a plurality of circuitous air passageways to allow air flow into and out of the hopper car while restricting moisture and other contaminants from entering the car. An improved hatch cover lock mechanism for securing a vented or non-vented cover to the hatch is easily adjustable to provide a tight seal between the cover and hatch, and provides a safe controlled opening of a non-vented cover. An improved seal or gasket is arranged between the cover and hatch.

51 Claims, 8 Drawing Sheets

VENTED HATCH COVER

DESCRIPTION

This invention relates in general to a vented hatch cover, and more particularly to a vented hatch cover for a railroad hopper car which covers the hatch on the roof of the car and provides a plurality of air passageways which facilitate the flow of air into and out of the hopper car while restricting the entry of moisture and other contaminants into the hopper car.

BACKGROUND OF THE INVENTION

Railroad hopper cars which carry bulk particulate materials or commodity, such as grain, food products, plastic pellets, powder, or other materials, have long been in use. Hopper cars generally have one or more compartments for storing and transporting these materials. Each compartment has at least one hatch in the roof of the car at the top of the compartment to facilitate loading of the materials and at least one outlet at the bottom of the compartment for facilitating unloading of the materials. A hatch cover is provided for each hatch to close the compartment after loading and thereby prevent foreign matter and moisture from entering the compartment and contaminating the stored materials during transit. After the hopper car reaches its destination, the hopper car is typically unloaded using a vacuum conveying line which is attached to the outlet at the bottom of each compartment. As the vacuum draws the material out of the compartment, air must be drawn into the compartment to maintain the efficiency of the vacuum and to prevent damage to the hopper car which could result from the negative pressure created in the compartment by the vacuum pressure. Heretofore, the hatch cover at the top of the hopper car was manually opened to facilitate entry of air into the compartment. To open the hatch, a person climbed on top of the car, unlocked the hatch cover, and manually opened the hatch cover. Besides the obvious safety problems associated with manually opening the covers, the covers were sometimes left open, which resulted in the entry of contaminants into the compartment and damage to the hatch covers.

Heretofore, it has been known to provide a vented hatch cover for railroad hopper cars to solve these problems as illustrated by U.S. Pat. Nos. 4,819,830 and 5,064,089. The vented hatch cover facilitates the entry of air into the compartment of the hopper car during the emptying of the particulate matter from the bottom of the compartment without the need for manually opening and closing the hatch cover. One problem associated with the entry of air into the compartment through the vented hatch cover is that foreign matter and moisture tend to be suspended in the air and carried into the compartment thereby contaminating the particulate matter during transit. To solve this problem, air filters have been used in vented hatch covers; however, the filter must allow sufficient air flow into the compartment to avoid negative pressure situations. Accordingly, there is a need for a vented hatch cover which eliminates the safety problems associated with manually opening the covers during unloading and which allows sufficient air flow into and out of the hopper car while restricting the entry of moisture and other contaminants into the car.

SUMMARY OF THE INVENTION

The present invention overcomes the above problems by providing a vented hatch cover which allows sufficient air flow into and out of the hopper car while restricting the entry of moisture and other contaminants from entering the car.

The vented hatch cover of the present invention is a four-quadrant ultra-violet stabilized impact resistant plastic assembly having coacting spaced apart top and bottom members which cover the hatch opening and provide multiple circuitous or tortuous air passageways to facilitate the flow of air into and out of the hopper car. The vented hatch cover is mounted on the coaming of the hatch and secured in place by a new and improved hatch locking mechanism which is pivotally attached to the hatch at one end and releasably attached to the hatch at the other end by an adjustable locking assembly.

The bottom member of the vented hatch cover assembly of the present invention includes a circular substantially rigid slightly dome-shaped body having upper and lower surfaces. A plurality of concentric rings are formed on and extend downwardly from the lower surface to add rigidity to the body. A new and improved gasket is circumferentially located adjacent to the lower surface between the outer two rings to form a seal with the upper edge or flange of the coaming and prevent any entry of contaminants between the cover and the coaming flange. Two U-shaped alignment slots for coacting with the top member are perpendicularly arranged in the body of the bottom member and divide the body into four quadrants. Each quadrant includes a plurality of inner and outer baffle members extending upwardly from the upper surface of the body and an opening which allows air to enter the compartment through the bottom member. The baffles have upwardly extending spaced apart ribs or shoulders which engage the top member of the vented hatch cover assembly and further define the air passageways.

The top member includes a substantially rigid circular dome-shaped body having a slightly larger circumference than the bottom member. The body of the top member has upper and lower surfaces and two perpendicularly arranged locking arm slots which are aligned with and received in non-airtight relation with the alignment slots in the bottom member. The locking arm slots divide the top member into four quadrants corresponding to the four quadrants of the bottom member. Each quadrant of the top member includes a plurality of inner and outer baffle members extending downwardly from the lower surface of the body and a plurality of supporting legs which engage the top surface of the body of the bottom member to support the top member and to provide sufficient spacing between the top and bottom members of the vented hatch cover assembly. The locking arm slots are defined by reinforcing channels which further strengthen the cover.

The upwardly extending baffles on the bottom member and the downwardly extending baffles on the top member coact to define a plurality of circuitous or tortuous air passageways in each quadrant and thus around substantially the entire circumference of the top and bottom members. The air passageways permit the flow of air into and out of the hopper car. The arrangement of the baffles tends to alter the speed of the air traveling through the top and bottom member to prevent contaminants and moisture from entering the body.

A detachable mesh filter is preferably secured by suitable fasteners to the outer baffles of the top member to prevent contaminants from entering the hopper car. Additionally, a filter assembly is mounted on the bottom member under the openings in each of the quadrants to further prevent contaminants and moisture from entering the compartment, and also to prevent the particulate material in the car from bouncing or moving back out and entering the baffle area in the cover that could clog the air passageways.

It is therefore an object of the present invention to provide an improved vented hatch cover for covering a hatch opening of a compartment for a railroad hopper car that includes a plurality of circuitous or tortuous air passageways which facilitate the flow of air into and out of the hopper car while restricting the entry of moisture and other contaminants into the car.

A further object of the present invention is to provide a vented hatch cover for a hopper car assembly including coacting top and bottom members having baffles which define a plurality of circuitous air passageways for entry of air into and out of a compartment of the hopper car.

A still further object of the present invention is to provide a vented hatch cover assembly for a hopper car compartment divided into multiple quadrants, wherein each quadrant provides a plurality of air passageways that facilitate the entry of air into and out of the compartment.

A further object of the present invention is to provide a new and improved hatch cover locking mechanism that is easy to operate and simple to adjust in order to properly secure the hatch cover in place on the hatch, and which when used with a non-vented hatch cover allows safe opening of the cover when the hopper car compartment is highly pressurized.

Another object of the invention is to provide a new and improved seal or gasket for a hopper car hatch cover that coacts between the hatch cover and the coaming of the hatch in order to provide a more efficient sealing arrangement and prevent contaminants from entering between the hatch and cover and which is reversible to double the life of the gasket.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
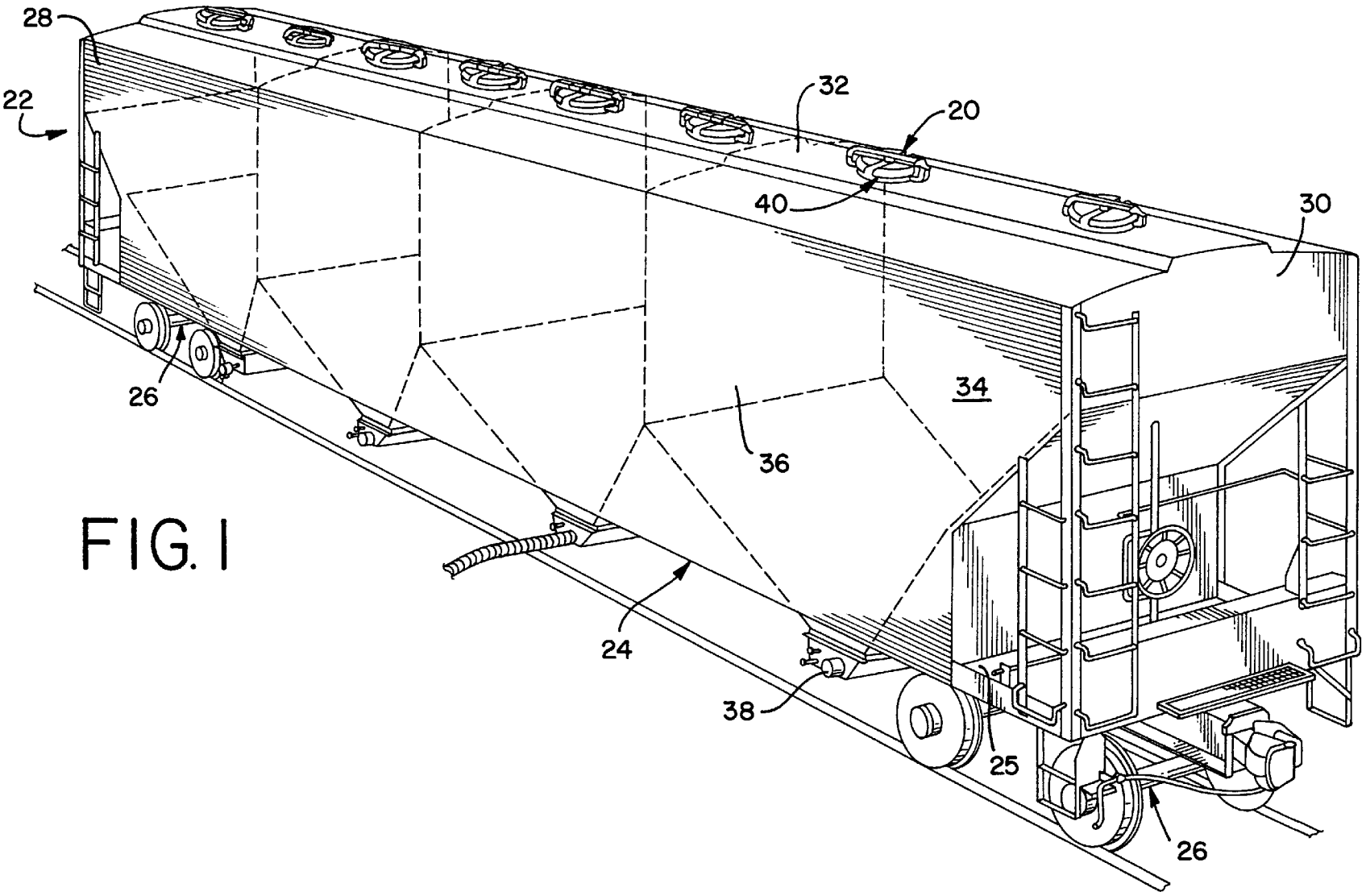
FIG. 1 is a perspective view of a railroad hopper car illustrating a plurality of vented hatch covers of the present invention mounted on the hatches in the roof of the hopper car.
Figure 2:
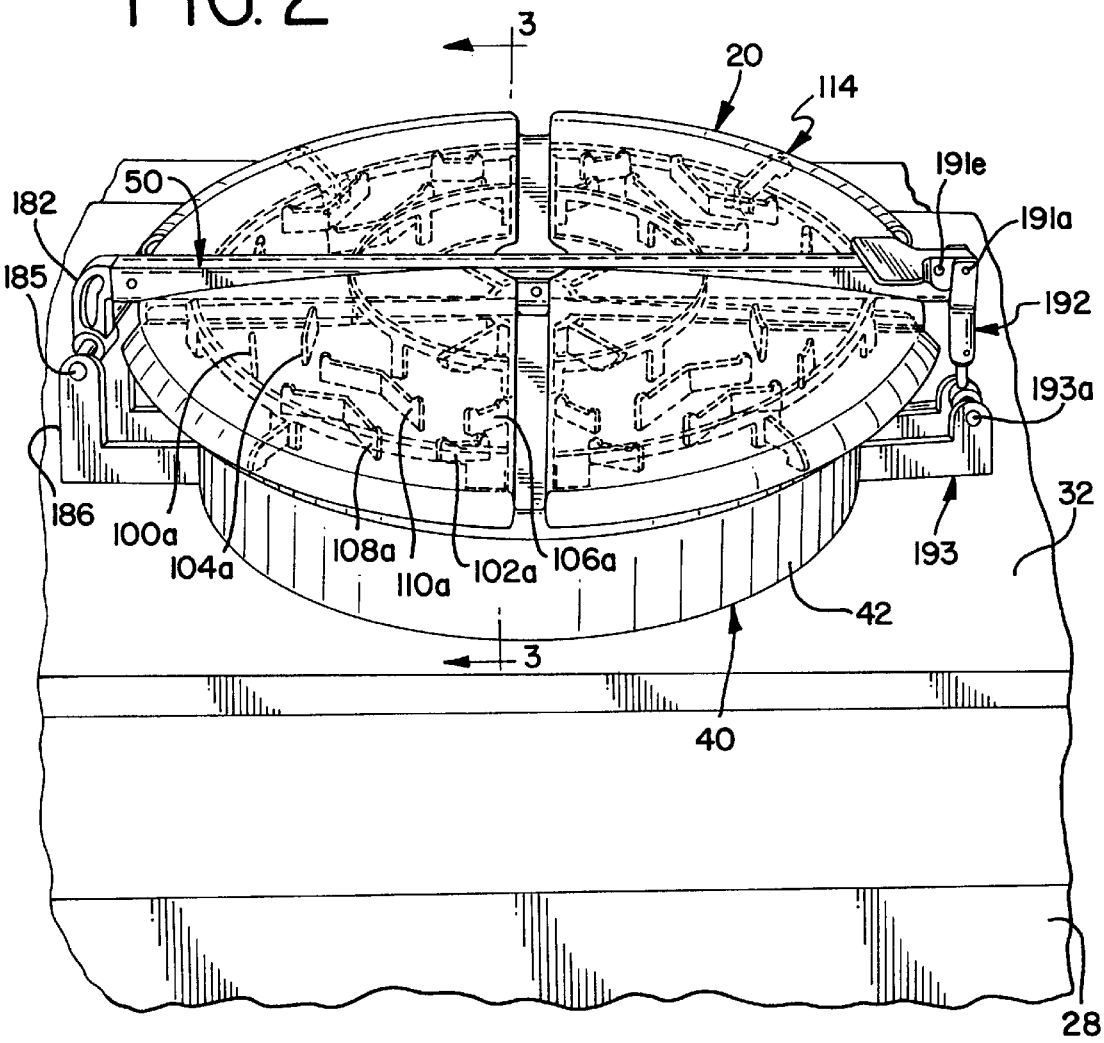
FIG. 2 is an enlarged perspective view of the vented hatch cover of the present invention mounted on the hatch of a hopper car and illustrating the over-center locking arm which holds the vented hatch cover on the hatch.
Figure 3:
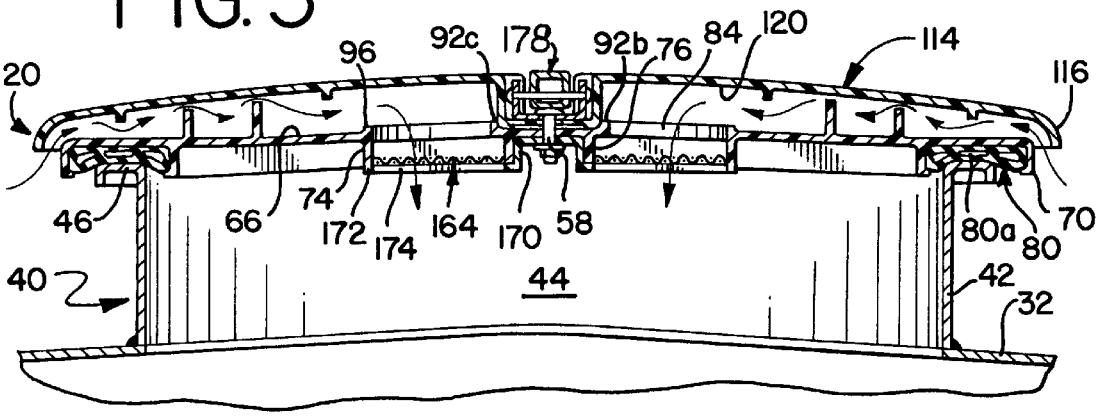
FIG. 3 is an enlarged cross-sectional view of the vented hatch cover mounted on the hatch of the hopper car taken substantially along line 3—3 of FIG. 2, and further illustrating the circuitous air passageways formed between the top and bottom members which allow air to enter the hopper car.

Referring now to the drawings, and particularly to FIGS. 1 to 3, the vented hatch cover of the present invention, generally indicated by the numeral 20, is shown mounted on a conventional railroad hopper car 22 that carries particulate materials. The hopper car 22 includes a frame 24 having a floor 25 mounted on conventional trucks 26, a pair of opposed side walls 28 extending upwardly from the floor 25, a pair of opposed end walls 30 extending upwardly from the floor 25, and a roof 32 supported by the walls 28 and 30. A plurality of compartments 34 for storing particulate material being transported are defined by the floor 25, side walls 28, end walls 30, roof 32, and/or interior walls or partitions 36. An outlet 38 is disposed at the bottom of each compartment 34 for unloading the materials by using a vacuum or other conventional means. A pair of hatches 40 are built into the roof 32 of the car 22 at the top of each compartment 34 for loading materials into the compartment as well as for venting the compartment during the unloading process. The vented hatch cover 22 of the present invention may be mounted on one or both of the hatches in each compartment depending on the flow of air desired in each compartment. A non-vented hatch cover may be mounted on the other hatch if only one vented hatch cover is employed. While the hopper car is illustrated in FIG. 1 with one outlet and two hatches, it should be appreciated that the number of outlets and hatches could vary and that the vented hatch cover of the present invention could be mounted on any number of hatches.

The hatch 40 consists of an annular coaming 42 integrally formed with and extending upwardly from the roof 32 of the car 22, as illustrated in detail in FIGS. 2 and 3. The coaming 42 defines an annular hatch opening 44 for the compartment. An annular flange 46 extends around the top of the coaming 42, although not all hatches have a flange. The vented hatch cover 20 of the present invention is adapted to engage and form a substantially air-tight seal with the annular flange 46, thereby only allowing air to enter the car through the plurality of circuitous air passageways defined by the vented hatch cover as shown by the arrows in FIG. 3.

Figure 4:
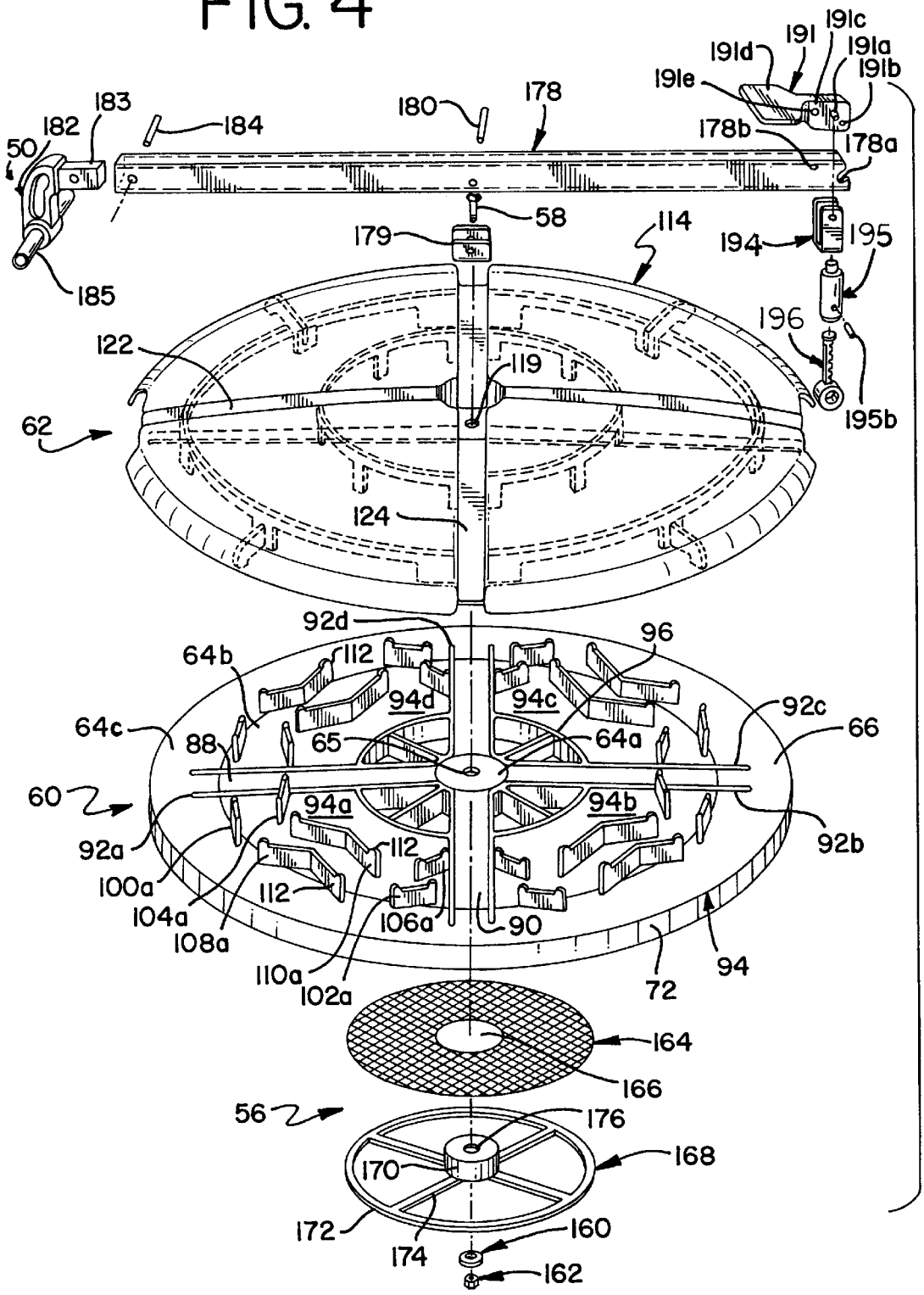
FIG. 4 is an exploded perspective view of the vented hatch cover assembly including the locking arm, the adjustable locking assembly, the top member, the bottom member, and the filter assembly.

Referring now to FIGS. 2 to 4, the vented hatch cover 20 of the present invention is secured to the hatch 40 by a hatch cover locking mechanism 50 which securely locks the vented hatch cover 20 to the hatch. The locking mechanism 50 includes an arm connected to the hatch and pivotally connected to the coaming 42 or the top wall of the car on one side of the hatch and releasably connected to the opposite side of the coaming by an adjustable locking mechanism as more particularly described below. Accordingly, the hatch may be opened for filling purposes by actuating the locking mechanism to allow the arm and hatch to be raised and pivoted to one side of the hatch.

The vented hatch cover 20 includes coacting circular bottom and top members 60 and 62 and a filter assembly 56 attached to the bottom member. Each of the bottom and top members 60 and 62 are preferably molded in one piece from a reinforced impact resistant and ultraviolet stabilized plastic, such as a calcium-filled polypropylene or otherwise suitably reinforced or filled polymer. The plastic compound utilized for the members and all other parts should be FDA approved where the members and parts may contact transported particulate material used in processing food and other products regulated by the Food and Drug Administration.

The bottom member 60 of the vented hatch cover 20, as further illustrated in FIGS. 5 to 8, includes a circular body 64 which is suitably sized to cover the entire hatch opening 44 and to extend over the flange 46 of the coaming 42. The body 64 has upper and lower surfaces 66 and 68, respectively, and is somewhat dome-shaped to prevent the accumulation of water on the upper surface 66 and allow water to run off the outer edges. More particularly, the body 64 has substantially flat inner and outer portions 64*a* and 64*c*, interconnected by a center portion 64*b* sloping downwardly from the inner portion 64*a* to the outer portion 64*c*. The inner portion 64*a* of the body 64 includes a centrally located aperture 65 for bolt or fastener 58 which holds together the top and bottom members including the filter assembly.

Figure 6:
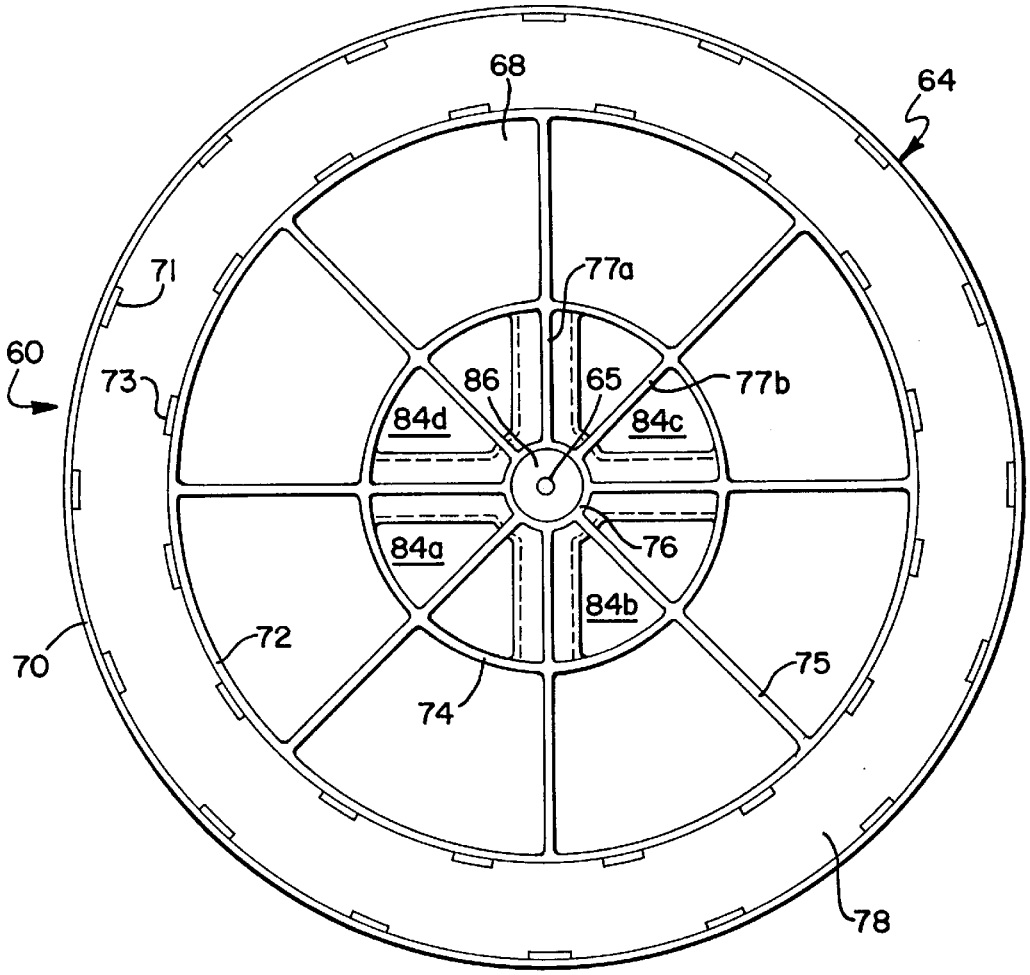
FIG. 6 is a bottom plan view of the bottom member.
Figure 8:
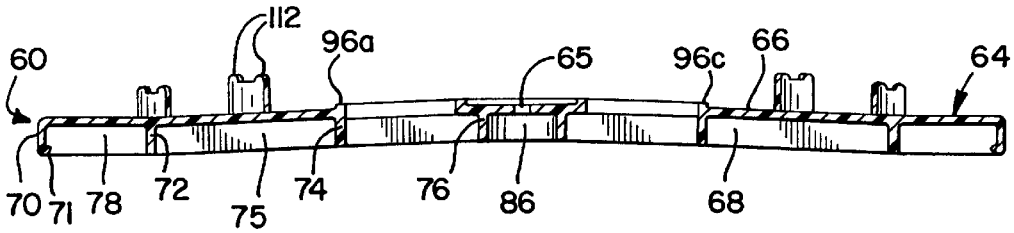
FIG. 8 is a cross-sectional view of the bottom member taken substantially along line 8—8 of FIG. 5.

A series of spaced apart concentrically arranged rings or ribs 70, 72, 74, and 76 are integrally connected to and extend downwardly from the lower surface 68 of the body 64 for providing structural rigidity for the circular body 64, as best seen in FIG. 6. It should be appreciated that additional ribs or rings may be added for further reinforcement of the body. An annular gasket receiving pocket 78 is defined between the two outermost concentric rings 70 and 72 for receiving an annular gasket or seal 80 which engages and forms a substantially air-tight seal between the cover and the flange 46 of the coaming 42, as illustrated in FIG. 3. Rings 70 and 72 each have a series of spaced apart gasket retention lips 71 and 73, respectively, formed adjacent to the bottom edges of the rings in alternatively opposed positions which coact to hold the gasket 80 in the pocket 78.

Figure 15:
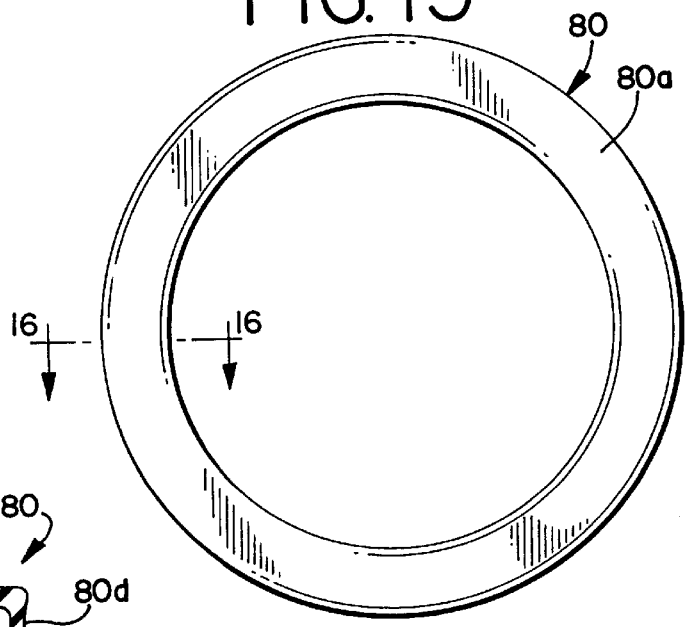
FIG. 15 is a plan view of the new and improved seal for the hatch cover.
Figure 16:
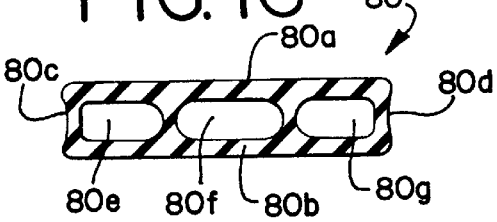
FIG. 16 is an enlarged detailed sectional view of the seal taken substantially along line 16—16 of FIG. 15.

The annular gasket 80 could be of any suitable natural or synthetic resilient material, it is preferably made from a white EPDM rubber having a Shore durometer hardness rating on the A scale of approximately seventy. The gasket is somewhat rectangular in cross section with generally concave opposing side walls. The gasket is preferably formed with a plurality of generally rectangular in cross section, air-filled lumens or compartments running annularly through the gasket. Referring to FIGS. 15 and 16, the annular shape of the gasket is illustrated, and it will be understood that it will be sized to fit in the annular pocket 78 of the cover and be retained by retention lips 71 and 73. As seen in FIG. 16, a cross section taken through a part of the gasket shows it to be generally rectangular. The gasket includes top and bottom parallel walls 80*a* and 80*b*, opposed substantially concave walls 80*c* and 80*d*, and rounded corners. Continuous lumens 80*e*, 80*f* and 80*g* extend annularly and each contain substantially atmospheric pressure, but are not connected to one another. The end wall configuration enhances the instability and fit of the gasket in the gasket channel of the cover. The gasket is made by extruding unvulcanized EPDM rubber and wrapping the extrusion around a mandrel, vulcanizing or curing the extrusion by heat, and removing the cured extrusion from the mandrel. The extrusion will maintain the circular shape of the mandrel. Then the extrusion is cut to size and the ends are adhesively secured together by a suitable adhesive so as to maintain the lumens continuous. Thus, the seam where the ends are secured together must not block the lumens or air passageways, and a uniform annular seal will be provided to provide the best possible sealing condition. The gasket may be inserted into the cover pocket from either direction because of its symmetrical shape and is therefore reversible for doubling gasket life by placing the clean side against the coaming. It should be appreciated the gasket could be used for both non-vented and vented hatch covers and is of an FDA material. It is further appreciated the gasket is made of a material and structured such that it will not take a set as in solid rubber gaskets heretofore used for hatch covers.

The bottom member 60 further includes a plurality of evenly spaced apart radially extending braces or ribs 75 arranged between and integrally connected to the rings 72 and 74, as well as the body 64 of the bottom member 60 to provide additional structural rigidity. A plurality of evenly spaced apart radially extending braces or ribs 77*a* and 77*b* are arranged between and integrally connected to rings 74 and 76 to provide further structural support to the bottom member 60. The ribs 77*a* are integrally formed with and extend downwardly from the body 64 while ribs 77*b* extend below the openings 84*a*, 84*b*, 84*c*, and 84*d* formed in the body 64 of the bottom member 60. These openings, which are positioned over the hatch opening 44, allow air to pass through the bottom member 60 into the compartment, as illustrated in FIG. 3. The central ring 76 defines a cavity 86 for receiving a part of the filter assembly 56, as described in more detail below.

The upper surface 66 of the bottom member 60 includes two perpendicularly arranged intersecting U-shaped alignment slots 88 and 90 which are adapted to receive the locking arm channel members 122 and 124 in the top member 62 to facilitate alignment of the top and bottom members 60 and 62, as further described below. The alignment slots 88 and 90 are defined by four substantially L-shaped coacting ridges 92*a*, 92*b*, 92*c*, and 92*d* which are integrally formed with and extend upwardly from the upper surface 66 of the body 64. The ridges 92*a*, 92*b*, 92*c*, and 92*d* divide the upper surface 66 of the body 64 into four substantially symmetrical quadrants 94*a*, 94*b*, 94*c*, and 94*d*. Arcuate ridges or members 96*a*, 96*b*, 96*c*, and 96*d* are respectively formed in each quadrant and extend upwardly from the body 64 of the bottom member at the edge of the openings 84*a*, 84*b*, 84*c*, and 84*d* to prevent any water on the upper surface 66 of the central portion 64*b* of the body 64 adjacent to those ridges from passing through the openings into the compartment of the hopper car.

A plurality of inner and outer baffle members are arranged on the upper surface 66 of the body 64 of the bottom member 60 in each quadrant. For instance, in quadrant 94*a*, baffles 100*a*, 102*a*, 104*a*, 106*a*, 108*a*, and 110*a* are integrally formed with and extend upwardly from the upper surface 66 of the body 64 and toward the member 62, as seen in FIGS. 2 and 3. The baffles may be substantially straight such as baffles 100*a*, 102*a*, 104*a*, and 106*a*, or somewhat V-shaped as baffles 108*a* and 110*a*, or may be otherwise suitably configured to define with the top member circuitous air passageways between the peripheral cover outside air inlet/outlet and the central compartment air outlet/inlet. The inner and outer rows of baffles are arranged to create the circuitous and somewhat zigzag air passageways over the central portion 64*b* of the body 64. At least two shoulders or ribs 112 are formed on opposite ends of the upper edge of each baffle, and additional shoulders 112 may be located therebetween such as on the angled baffles 108*a* and 110*a*. The shoulders extend upwardly from the baffles and engage the top member 62 to further define air passageways between and over the baffles. In addition to defining these air passageways, the plurality of shoulders in each quadrant and on all of the baffle members of the bottom member 60 coact to provide support for the top member and to space the top member from the bottom member. The preferred arrangement of the baffle members is illustrated in FIGS. 2 to 8; this arrangement provides a sufficient amount of air to flow into the compartment of the hopper car. It should be appreciated that the number, shape, and arrangement of the baffle members and the shoulders could vary in accordance with the vented hatch cover of the present invention and to vary the amount of air flow through the top and bottom members.

Referring now to FIGS. 2 to 4 and 9 to 12, the top member 62 has a substantially circular generally dome-shaped body 114 suitably sized to cover and span the entire bottom member 60 and includes an outer annular rim 116 which extends beyond the outermost ring or flange 70 of the bottom member 60 when the top and bottom members of the vented hatch cover are assembled, as specifically illustrated in FIG. 3. The dome-shaped body 114, which has a substantially smooth upper surface 118, prevents accumulation of water on the top of the vented hatch cover 20. The body 114 has a centrally disposed aperture 119 for receiving a bolt 58 which holds together the top and bottom members of the vented hatch cover. The lower surface 120 of the body 114 engages the shoulders 112 that extend upwardly from the baffles of the bottom member and includes a plurality of downwardly extending annularly arranged supporting legs 138 which engage the upper surface 66 of the body 64 of the bottom member 60 to support the top member 62 on the bottom member and to space apart the top and bottom members.

Two perpendicularly arranged U-shaped locking arm slots or channels 122 and 124 are formed in the body 114 for receiving the locking arm 50. A pair of recesses 126 and 128 are formed along the periphery of the body 114 at opposite ends of the locking arm slot 122 to accommodate the hinge and latch of the cover locking mechanism. The locking arm slots or channel members 122 and 124 divide the body 114 of the top member 62 into four substantially symmetrical quadrants 130*a*, 130*b*, 130*c*, and 130*d*, which correspond with the quadrants 94*a*, 94*b*, 94*c*, and 94*d* on the bottom member 60 when the members are assembled. The quadrants in the top member 62 are further defined by L-shaped walls 132*a*, 132*b*, 132*c*, and 132*d* extending downwardly from the channel members into engagement with the upper surface 66 of the body 64 of the bottom member 60 and are disposed between the ridges 92*a*, 92*b*, 92*c*, and 92*d* of the alignment slots 88 and 90. The downwardly extending walls 132*a*, 132*b*, 132*c*, and 132*d* support the top member 62 relative to the bottom member and separate each of the quadrants of the top and bottom members and the plurality of air passageways defined in each of the four quadrants.

A plurality of inner and outer baffle members are arranged on the lower surface 120 of the body 114 of the top member 62 in each quadrant. For instance, in quadrant 94*a*, arcuately shaped outer baffles 134*a* and 135*a* and inner baffles 136*a* and 137*a* are concentrically arranged on the lower surface 120 of the body 114 of the top member 62. The baffles 134*a*, 135*a*, 136*a*, and 137*a* are integrally formed between the supporting legs 138 and extend downwardly from the lower surface 120 of the body 114 but coact with the top surface of the lower member to define air flow openings. The outer baffles 134*a* and 135*a* or the outer supporting legs 138 may be formed with centrally located apertures 140 which are adapted to receive conventional button fasteners 142 or other suitable fasteners to maintain a mesh filter 144 in place along the outer baffles. The mesh filter extends over the air flow openings defined by the outer baffles to prevent contaminants from entering the compartment of the hopper car. The mesh filter is installed on the top member prior to assembly of the bottom and top members 60 and 62. The mesh filter may be made of a suitable mesh size wire or plastic screen which permits sufficient flow of air and prevents contaminants from entering the compartment of the car. The screen and the button fasteners 142 would be made of an FDA approved material. The filter may be placed on the interior or exterior walls of either or both inner or outer baffles in each quadrant to prevent contaminants from entering the hopper car through the vented hatch cover.

Prior to installation of the vented hatch cover of the present invention on the hopper car, the bottom and top members 60 and 62 are assembled with the filter assembly 56. More particularly, the bottom and top members are aligned with the locking arm slots 122 and 124 mating with the alignment slots 88 and 90. A U-shaped bracket 179 for attaching the locking arm 178 to the vented hatch cover 20 is inserted in the intersection of the locking arm slots. The bracket 179 has a bottom wall with a centrally located aperture for receiving the bolt 58 and two spaced apart arms having aligned apertures for receiving a pin which extends through the locking arm 178 to secure the locking arm to the bracket. The bracket is positioned in the center of the body 114 of the top member 62 to align the aperture with the centrally located aperture 119 in the body 114 of the top member 62. The bolt 58 is inserted through aperture in the bracket 179, through aperture 119 in the top member 62, through the aperture 65 in the bottom member 60, and through the aperture 176 in the filter assembly 56, where a washer 160 and nut 162 are attached to the bolt 58 to hold the top and bottom members of the vented hatch cover together in assembled relationship.

The filter assembly 56 includes a retainer member 1 68 having a cylindrical hub 170, an outer rim 172, and a plurality of spokes 174 connecting the rim 172 to the hub 170. The retainer member is adapted to support and maintain a mesh filter 164 adjacent to the openings in the body of the bottom member. The mesh filter is suitably sized to fit between concentric rings 74 and 76 and includes a central opening 166 for placement over the hub 170. The hub 170 is suitably sized to be inserted into the cavity 86 defined by the center ring 76. The centrally located aperture 176 in the hub 170 is adapted to receive the bolt, and the washer and nut are secured to the bolt in the bore of the hub, as described above and seen in FIG. 3. Further, resilient sealing washers are preferably applied on the bolt 58 between the bracket 179 and the cover, and also the underside of the cover and the hub 170 of the retainer to prevent water leakage into the compartment along the bolt.

The hatch cover 20 is locked onto the hatch 40 by the hatch cover lock mechanism 50, which is shown particularly in FIGS. 2, 3, 4, 13 and 14. This mechanism includes an elongated box-shaped in cross section arm 178 that fits in the channel 122 of the cover and is centrally pinned to the U-shaped bracket 179 on the cover by a pin 180 that extends through holes in the arm 178 and holes in the bracket. Thus, the locking arm provides substantially uniform loading from the center of the locking arm to the cover, thereby providing substantially uniform loading of the gasket along the coaming to assure a water-tight seal between the cover and the coaming. As above explained, the bracket 179 is secured to the cover by bolt 58 and nut 162.

One end of the arm is connected to a hinge member 182 by having a lug 183 fitted into the end of the arm and secured to the arm by a pin 184. The hinge 182 is an inverted L-shaped member and includes a pivot shaft 185 pivotally received in an L-shaped bracket 186 that is suitably connected to the coaming 142 although the bracket may be connected to the coaming and the car roof or just to the car roof. Thus, the arm and hatch cover are pivotally mounted relative to the hatch so that the hatch cover may be disposed in open position or in closed position over the hatch.

The other end of the arm of the hatch cover lock mechanism is releasably locked in closed position by an adjustable locking device 190 pivotally connected at one end to the hatch or car and selectively connected at its other end to the arm 178. This locking device includes an overcenter toggle locking lever 191 pivotally connected to an adjustable link 192 that is in turn pivotally connected to an L-shaped bracket 193 that is suitably secured to the coaming. It should be appreciated that alternatively the bracket may be connected to the coaming and the car roof or only to the roof. The bracket 193 includes a pair of arms for receiving therebetween the lower end of the adjustable link 192. The adjustable link includes a U-shaped clevis 194, an adjusting barrel shaft or hub 195 that is secured to the clevis, and an adjusting bolt or pin 196 that is adjustably connected to and received in a bore 195*a* of the barrel shaft. The lever 191 is pivotally connected to the clevis 194. The adjusting bolt 196 includes a round head 196*a* at one end with a bore 196*b* therethrough and positionable between the arms of bracket 193 to be pivotally carried on a shaft 193*a* held by the arms. Accordingly, the adjustable lock is pivotally mounted on the car.

A stem 196*c* extends from the head 196*a* and includes a plurality of equally spaced apart locking grooves 196*d* extending perpendicularly of the stem long axis and more than half way around the periphery of the stem. A longitudinally extending flat surface 196*e* is provided along the stem opposite the midpoints of the grooves which functions to unlock the stem from the barrel shaft 195, as further explained below, so that the length of the adjusting link can be changed. Except for the flat side 196*e*, the stem is cylindrically shaped and sized with tolerances relative to the bore 195*a* of the barrel shaft, such that minor contamination will not cause binding between the stem and barrel shaft to thereby assure easy adjustment of the link even after extensive usage. At the end of the bolt 196 opposite the head, a retaining flange 196*f* functions to prevent complete removal of the bolt from the barrel shaft 195 during length adjustment of the link. The adjusting barrel shaft 195 includes a blind bore for matingly receiving the stem of bolt 196 so that the stem may easily rotate within the bore. A locking pin 195*b* traverses the bore to coact with the stem and adjustably lock the bolt to the shaft. When the grooves of the stem engage the locking pin 195*b*, the bolt 196 and shaft 195 are locked together against relative longitudinal movement. Rotation of the shaft 180 degrees to align the flat 196*e* with the locking pin 195*b* releases locking engagement of the bolt to locking pin 195*b* and permits longitudinal movement of the bolt 196 relative to the shaft 195 to change and adjust the length of the link.

The adjusting shaft 195 includes a reduced section 195*c* at its upper end that is press-fit into a bore formed in the U-shaped clevis 197 and accordingly nonrotatively connected to the clevis. The ears of the clevis include aligned holes for pivotally receiving the opposed pins 191*a* on the lever 191.

The lever 191 includes opposed shafts or pins 191*a* for pivotally mounting the lever on the clevis 197. A pin 191*b* is carried by the channel shaped base 191*c* of the lever for engaging an upwardly extending substantially undirectional or straight slot 178*a* at the end of arm 178.

Forward of the base 191*c* is a paddle-shaped handle 191*d* for grasping when manipulating the lever. Holes 191*e* extend through the base 191*c* and align with holes 178*b* through which a pin or wire may be removably extended to lock the lever down against the arm 178.

Adjustability of the adjusting link 192 is accomplished when the latch has been removed from the locking arm 178 and by rotating the shaft 189 one hundred eighty degrees to align the flatted side 196*e* of the adjusting bolt 196 with the locking pin 195*b* to allow relative longitudinal movement between the shaft 195 and the adjusting bolt to align a desired groove 196*d* so that upon rotation of the shaft relative to the bolt 196 the adjusting bolt 196 can be again engaged by the locking pin 195*a* of the shaft. Thus, depending upon the particular groove of the locking bolt that engages the pin 195*a* the link may be lengthened or shortened to assure proper sealing of the hatch cover on the coaming.

The entire hatch cover lock mechanism is preferably made of rust-resistant metals, and particularly aluminum or stainless steel. The hinge member 182 is made of cast aluminum, while the arm 178 is extruded aluminum. The lever 191 and clevis 197 are made of stainless steel. The adjusting shaft or tube 195 is made of machined aluminum, and the adjusting pin or bolt 196 is made of cast aluminum.

It should also be appreciated that the locking mechanism may be used with hatch covers of other designs including non-vented hatch covers. The hatch cover lock mechanism includes a very significant safety feature when used for a non-vented cover, in that the seal of the cover can be broken to allow cracking of the hatch while still maintaining the cover in at least partially closed position, thereby controlling the release of a high positive pressure from within the compartment. Without some device for controlling the opening of a non-vented cover, the worker could be injured by the cover when it is released from the coaming.

In operation, when locking the hatch cover in closed position, the lever 191 is pivoted on the clevis 197 to about a three o'clock position relative to the adjustable link 192 so that the link and lever can be pivoted toward the slotted end of the locking arm to cause the pin 191*b* of the lever to enter and engage the upwardly extending slot 178*a* at the end of the arm 178, after which the handle is pivoted overcenter to the position shown in FIG. 2 against the arm 178 to draw the cover tightly against the hatch and in sealed position. In the overcenter position, the locking pin 191*b* engaging the outwardly extending locking slot 178*a* of the arm 178 passes a line extending through the centers of pivot pins 191*a* and the pivot shaft 193*a*. Then any upward pressure on the cover would drive the lever 191 tighter against the arm 178. The holes 191*e* in the lever 191 align with holes 178*b* in the arm 178, after which a removable pin or wire can be inserted to lock the lever in place on the arm. Reversal of the closing and locking procedure results in opening the hatch. Moving the lever from a lock position at about nine o'clock to a twelve o'clock position, as shown in solid lines in FIG. 13, allows cracking of the cover to release any pressure. Continued clockwise rotation of the handle will free the lever from the arm slot 178*a* to allow the cover to be swung to a fully open position. Thus, it can be seen that the hatch cover lock mechanism may be easily actuated to open or close the hatch and easily adjusted to facilitate the accurate locking of the hatch cover on the hatch of the coaming in properly sealed relation.

As above mentioned, the use of the hatch cover latch mechanism on a non-vented hatch cover takes advantage of the safety feature built into the mechanism to provide a controlled safe opening of such a cover that is subject to a high positive compartment pressure. Release of the cover and cracking of the hatch is accomplished by rotating the overcenter toggle lever from the closed and locked position shown in FIG. 2, to the three o'clock phantom position shown in FIG. 13. The upwardly extending slot 178*a* in the end of the locking arm coacts with the locking pin 191*b* on the lever to maintain the cover in slightly open position until the locking pin 191*b* of the lever and the link are swung clear of the slot 178*a*. Thereafter, the cover may be fully swung to open position if desired. Where a high compartment pressure is encountered, the operator opening the hatch is fully protected against injury from the cover because it is restrained against completely opening. Thus, the mechanism eliminates the need to employ some other restraining device to prevent the cover from exploding open upon release by a locking mechanism.

Figure 5:
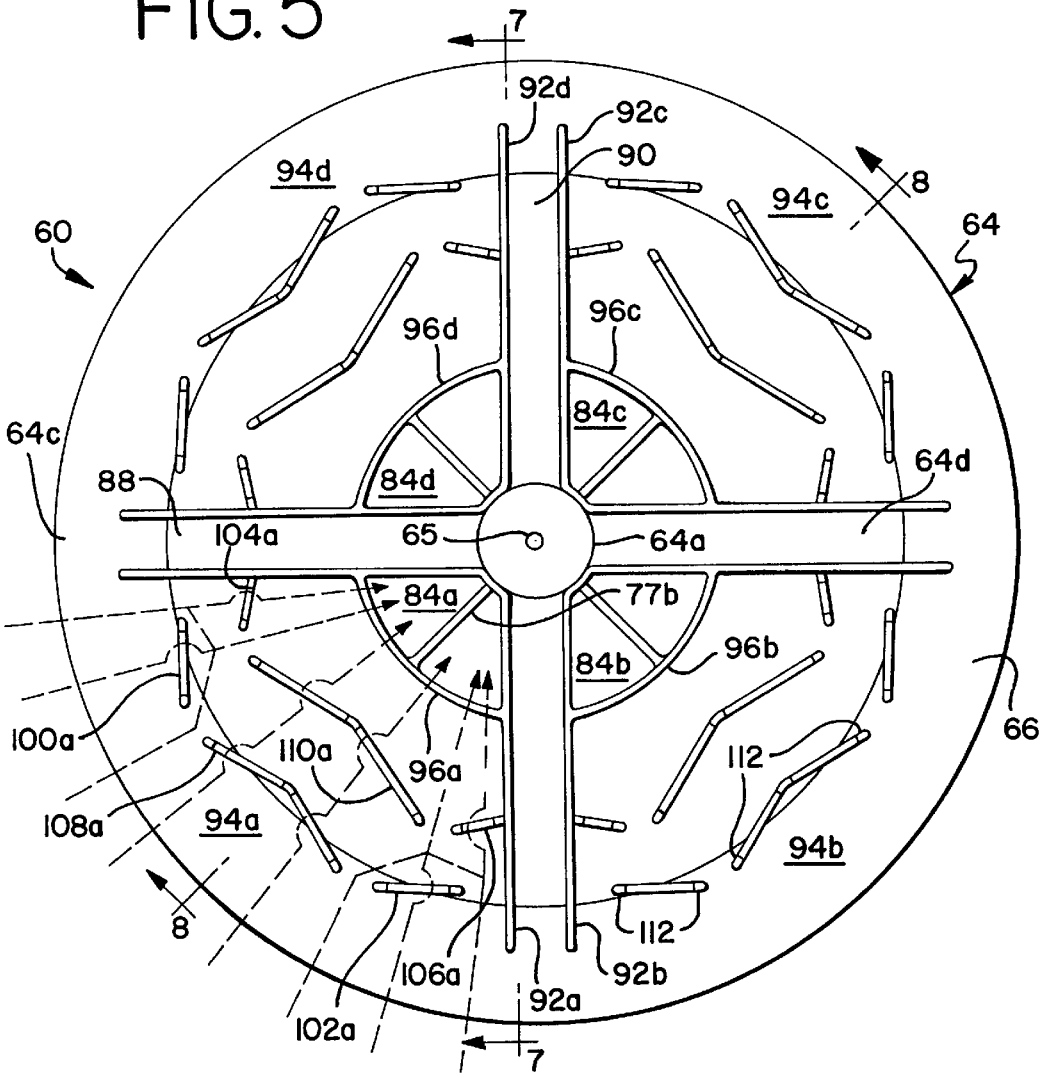
FIG. 5 is a top plan view of the bottom member.
Figure 7:
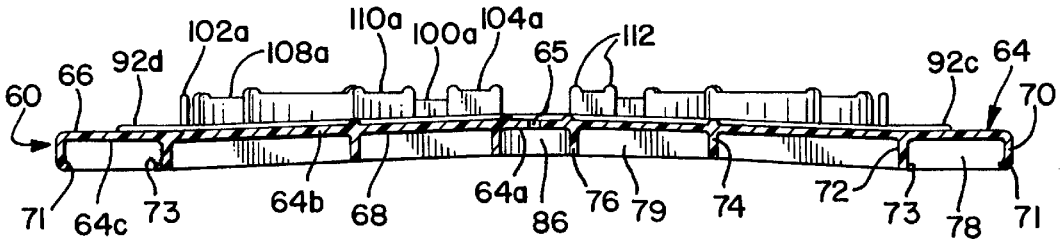
FIG. 7 is a cross-sectional view of the bottom member taken substantially along line 7—7 of FIG. 5.
Figure 9:
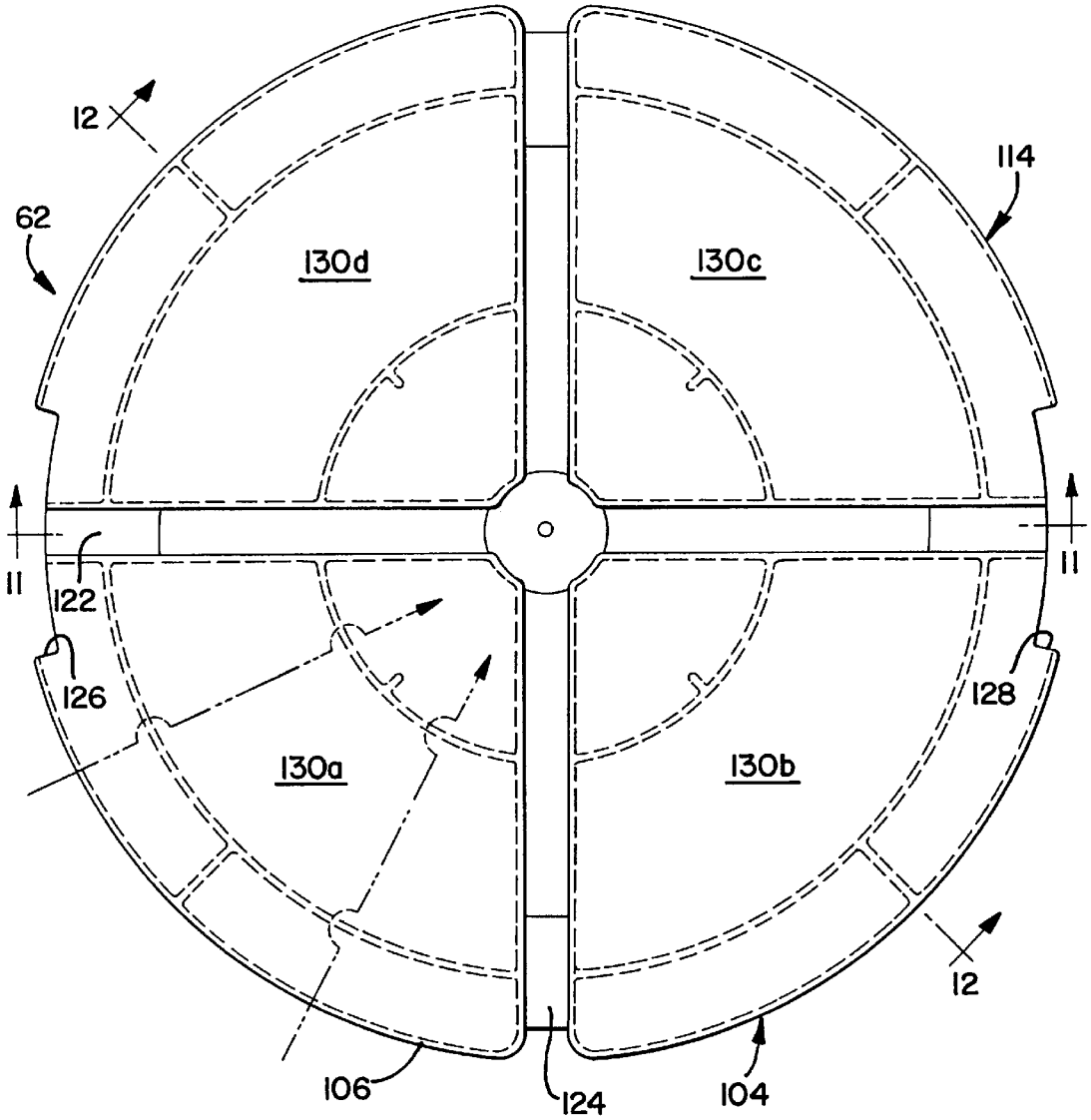
FIG. 9 is a top plan view of the top member.
Figure 11:
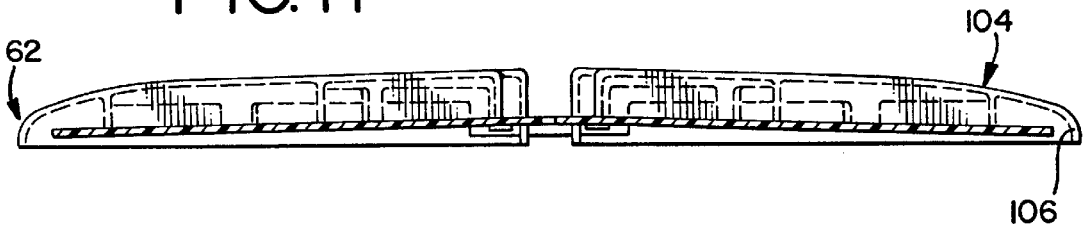
FIG. 11 is a cross-sectional view of the top member taken substantially along line 11—11 of FIG. 9.
Figure 10:
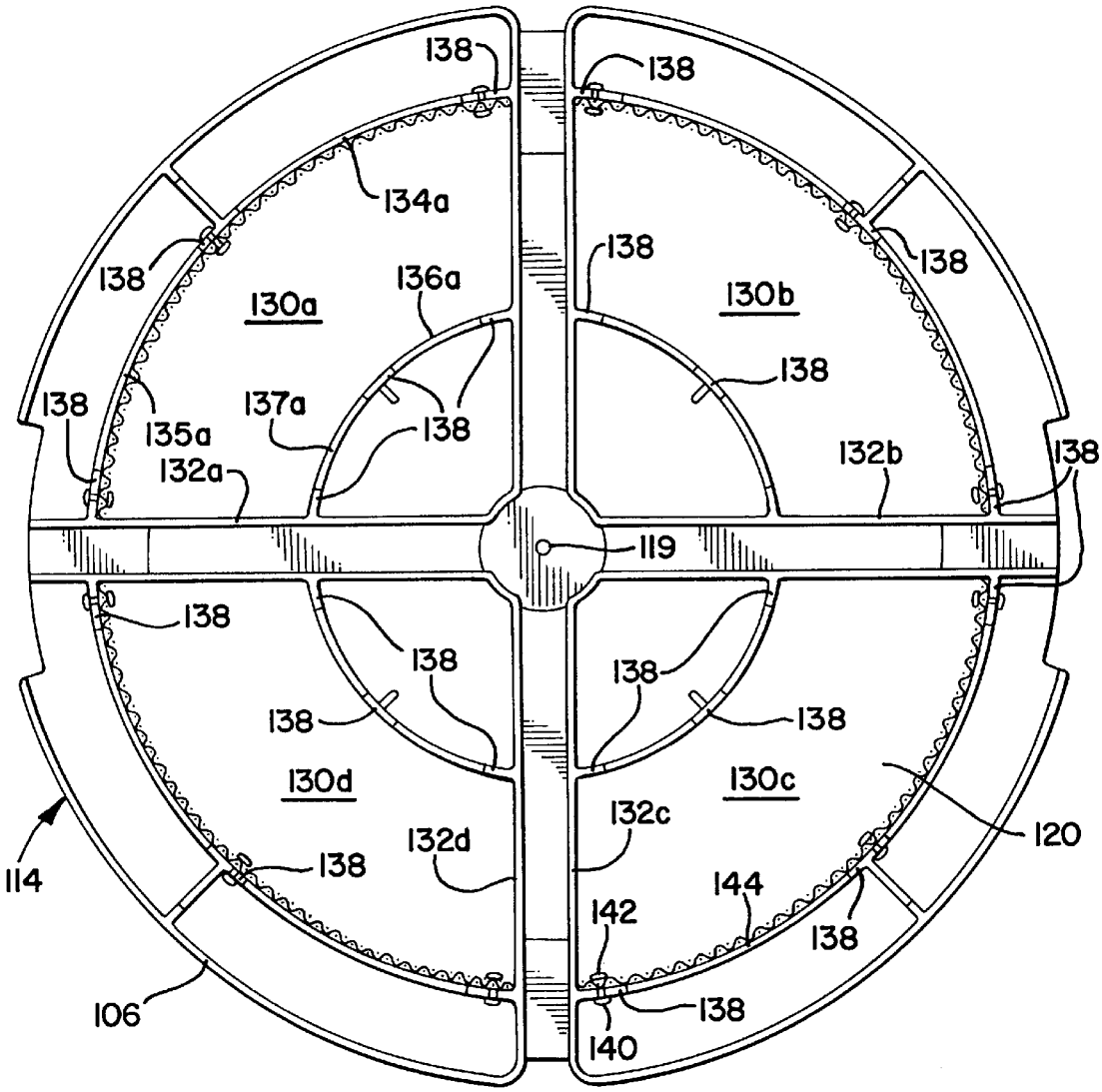
FIG. 10 is a bottom plan view of the top member.
Figure 12:
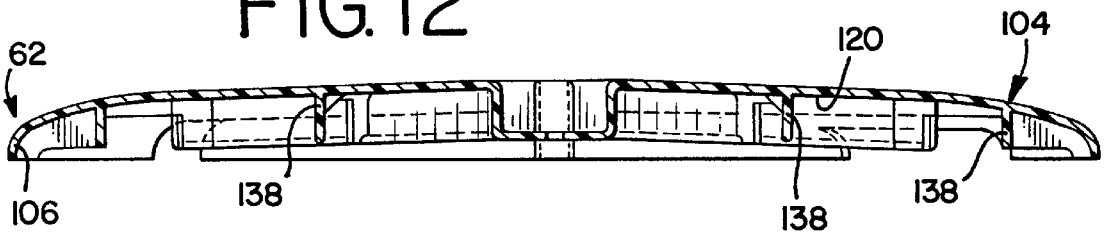
FIG. 12 is a cross-sectional view of the top member taken substantially along line 12—12 of FIG. 9.
Figure 13:
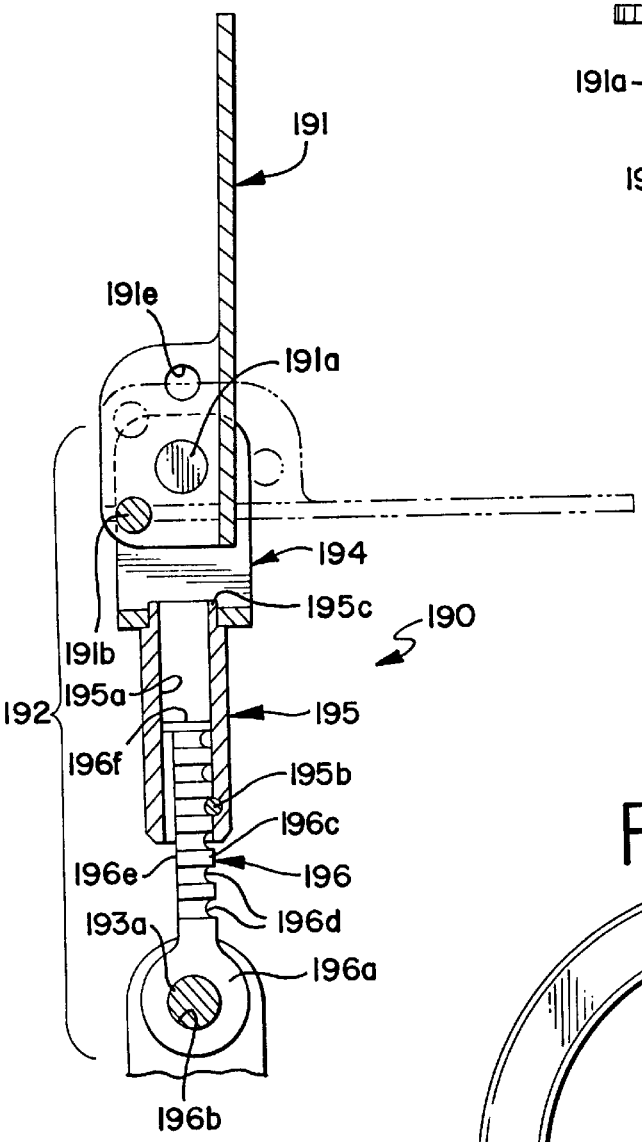
FIG. 13 is a vertical sectional view taken through the hatch cover lock mechanism and illustrating the adjustable link in locked position.
Figure 14:
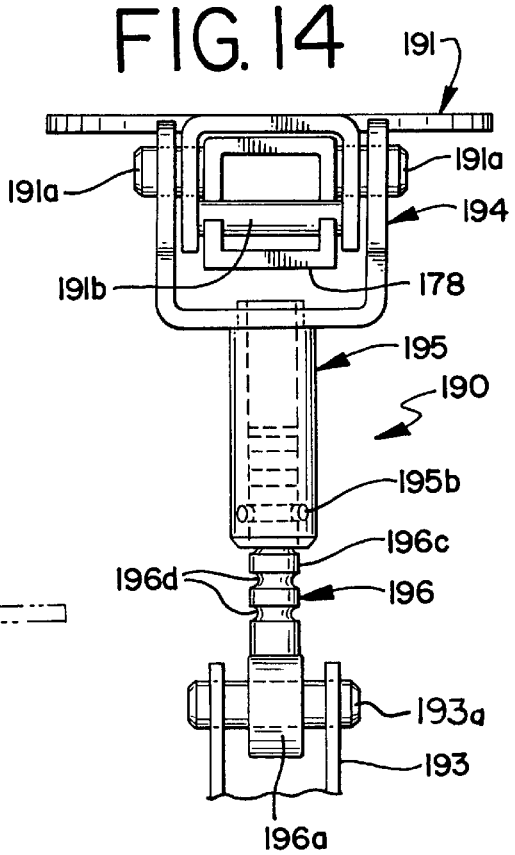
FIG. 14 is an end view of the hatch cover lock mechanism showing the mechanism in locking position with the locking arm.

The top and bottom members 60 and 62 of the vented hatch cover define a plurality of circuitous air passageways in each quadrant which allow a sufficient amount of air to flow into and out of the compartment 34 of the hopper car through the hatch opening 44 while restricting the flow of moisture and other contaminants into the compartment. The air flow of one quadrant will be described, although it will be the same in the other quadrants. In quadrant 130*a* of the top member and quadrant 94*a* of the bottom member, as illustrated in FIG. 3, air enters the vented hatch cover between the outer rim 116 of the top member 62 and the outer ring 70 of the bottom member 60. The air is then directed downwardly by and must flow under the downwardly extending outer baffles 134*a* and 135*a* of the top member. The air then is directed upwardly by and over the upwardly extending outer baffles 100*a*, 102*a*, 104*a*, 106*a*, 108*a*, and 110*a* of the bottom member. The air is also directed around both sides of those outer baffles 100*a*, 108*a* and 102*a*. The air flows into the pocket created between the inner and outer baffles of the bottom member, and then once again, the air is directed upwardly over and around the upwardly extending inner baffles 104*a*, 106*a*, and 110*a* of the bottom member. The air is then directed downwardly by and must flow under the downwardly extending inner baffles 136*a* and 137*a* of the top member. The air is then slightly directly upwardly by ridge 96*a* and downwardly by the lower surface of the top member into the opening 84*a* on either side of brace 77*b*. The combination of the downwardly sloping central portion 64*b* of the body and the upwardly extending ridge 96*a* adjacent to the opening 84*a* prevent water which is drawn into the vented hatch cover from entering the compartment. The combination of the filters and the circuitous path provided by the baffles substantially eliminates any contaminants suspended in the air. Air flow arrows are shown in FIGS. 3, 5 and 9 to generally illustrate air flowing from the exterior through the cover and into the compartment, although it will be understood that air flow may be in either direction.

It will be understood that modifications and variations may be effected without departing from the scope of the novel concepts of the present invention, but it is understood that this application is to be limited only by the scope of the appended claims.

The invention is hereby claimed as follows:

1. A vented hatch cover for covering a hatch opening of a compartment defined by a coaming, said vented hatch cover comprising:

a first member having means for forming a seal with said coaming, a second member spanning said first member and being in supported spaced apart relation to said first member, said second member being peripherally larger than said first member to define a downwardly facing peripheral opening with said first member, and at least one of said first and second members having means for defining a plurality of circuitous air passageways between said first and second members which allow air to be drawn into the compartment while preventing moisture and other contaminants from entering the compartment.

2. The vented hatch cover of claim 1, wherein the sealing means includes a pocket formed in the first member for receiving a gasket which engages the coaming to form said seal.

3. The vented hatch cover of claim 1, wherein the first member includes a substantially rigid body and the passageway defining means includes protrusions extending from said body toward said second member and being spaced from the first member.

4. The vented hatch cover of claim 1, wherein the second member includes a substantially rigid body and the passageway defining means includes protrusions extending from said body toward said first member.

5. The vented hatch cover of claim 1, wherein said first and second members are molded from an ultra-violet stabilized impact resistant plastic.

6. The vented hatch cover of claim 1, wherein the first member includes a first substantially rigid body and first protrusions extending from said body thereof, and the second member includes a second substantially rigid body having second protrusions extending therefrom and toward said first body said first and second protrusions coacting with said bodies to define said plurality of air passageways.

7. The vented hatch cover of claim 6, which further includes filter means for trapping contaminants suspended in the air which flows through the vented hatch cover.

8. The vented hatch cover of claim 7, wherein the filter means includes a filter attached to the second protrusions of the second member.

9. The vented hatch cover of claim 6, wherein the vented hatch cover including the first and second members are divided into multiple quadrants which each define said circuitous air passageways.

10. The vented hatch cover of claim 9, wherein each quadrant includes an opening in the first body of the first member which allows the air to enter the compartment.

11. The vented hatch cover of claim 10, which further includes ridge means in each quadrant extending adjacent to said opening for preventing water on the first body of the first member from entering the compartment through the opening.

12. The vented hatch cover of claim 11, wherein the first member includes inner and outer first protrusions arranged in each quadrant.

13. The vented hatch cover of claim 12, wherein the second member includes inner and outer second protrusions arranged in each quadrant.

14. The vented hatch cover of claim 13, wherein the inner and outer first protrusions are substantially straight and arranged between the inner and outer second protrusions.

15. A vented hatch cover assembly for covering a hatch having an opening in a compartment defined by a coaming, said assembly comprising:

a bottom member covering the hatch and having means for forming a seal with said coaming and at least one opening for allowing air to enter said compartment through said bottom member, a top member spanning said bottom member and engageable with said bottom member in spaced apart relation therewith, said top member being peripherally larger than said bottom member to define a downwardly facing peripheral opening with said bottom member, at least one of said top and bottom members having protrusion means extending toward the other of said members and spaced therefrom for defining a plurality of air passageways between said top and bottom members which allows air to be drawn into the compartment from the atmosphere, means for securing said top member to said bottom member, and means for securing said cover assembly to said hatch, whereby the compartment is vented without opening the hatch.

16. A vented hatch cover for covering a circular hatch opening of a compartment defined by an annular coaming, said vented hatch cover comprising:

a first member including a substantially circular first body, an annular gasket disposed adjacent to the first body to form a seal with the coaming, a plurality of inner and outer first baffle members extending from the first body, and at least one opening in the first body which allows air to enter the compartment, a second member including a substantially circular second body having a slightly larger circumference than the first body, a plurality of inner and outer second baffle members extending from the second body, and means for spacing said first body from said second body, said first baffle members and said second baffle members coacting to define a plurality of circuitous air passageways between the first and second members which facilitate the flow of air into and out of the compartment while inhibiting contaminants from entering the compartment, whereby the arrangement of the baffles tends to alter the speed of the air traveling between the first and second members to prevent contaminants and moisture from entering the compartment.

17. The vented hatch cover of claim 16, wherein the inner and outer first baffle members of the first member are arranged between the inner and outer second baffle members of the second member.

18. The vented hatch cover of claim 16, wherein a plurality of shoulders extend from the first baffle members to further define the air passageways.

19. The vented hatch cover of claim 16, wherein ridge means extends adjacent to said opening for preventing water on the first body from entering the compartment through the opening.

20. The vented hatch cover of claim 16, wherein filter means is attached to said first member adjacent to said opening for preventing contaminants from entering the compartment.

21. The vented hatch cover of claim 16, wherein filter means is attached to at least one of said inner and outer second baffle members of said second member for preventing contaminants from entering the compartment.

22. The vented hatch cover of claim 21, wherein the filter means includes a mesh filter member and button fasteners which are adapted to be inserted into one of the outer or inner second baffle members to hold the mesh filter member in place.

23. In a railroad hopper car including a compartment for storing and transporting materials, an outlet in said compartment for unloading said materials from said compartment, and a hatch in said compartment for loading said materials into said compartment, said hatch opening defined by a coaming, the improvement being in vented hatch cover means for closing said opening and for providing a plurality of air passageways for air to enter said compartment during unloading of said materials, said vented hatch cover means comprising a bottom member, a top member spaced from said bottom member and spanning said bottom member, said top member being peripherally larger than said bottom member to define a downwardly facing peripheral opening with said bottom member, said bottom and top member having coacting protrusion means extending toward the other of said members and spaced therefrom for defining a plurality of circuitous air passageways between said bottom and top members which allow air to be drawn into the compartment while preventing moisture and other contaminants from entering the compartment.

24. The vented hatch cover means of claim 23, wherein the means for defining a plurality of passageways includes alternatively opposing protrusion means extending from the bottom and top members.

25. A hatch cover lock mechanism for locking a hatch cover in pressure sealed relation to a hatch of a compartment on a railroad hopper car which comprises:

a locking arm centrally connected to the hatch cover, said arm having a hinge end extending from one side of the cover and a latch end extending from the other side of the cover, said latch end including an upwardly extending locking slot, a hinge connected to said hinge end of the arm and pivotally connected to the car so that the cover may be pivoted between open and closed positions, a latch assembly at the latch end of the arm removably connectable to the arm and pivotally connected to the car to facilitate connecting/disconnecting of the assembly to the arm, said latch assembly including a length adjusting link for adjusting the locked distance between the arm and the car, said link including a bolt adjustably received in a hub or shaft and pivotally connected to the car, whereby rotation of the hub approximately 180 degrees relative to the bolt unlocks the hub and permits longitudinal movement of the hub, and an overcenter toggle lever connected to the link for removable engagement with the upwardly extending slot of said latch end of the arm rotatable between locking and release positions and for forcing the cover in pressure sealed relation to the hatch when in locked position.

26. The mechanism of claim 25, wherein it is made entirely of rust inhibiting materials.

27. The mechanism of claim 25, wherein said lever includes a locking pin engaging the locking slot of the arm that coacts with the lever to maintain hold-down engagement with the locking slot and arm when the lever is in release position until the link and lever are swung away from the latch end of the arm, thereby preventing explosive opening of the cover where the compartment is under high pressure.

28. The mechanism of claim 25, wherein the hub of said adjustable link includes a bore having a locking pin traversing one side thereof near the entry of the bore, and said bolt including a stem having equally spaced apart grooves for selectively engaging the locking pin of the hub and a longitudinally extending flat side that when aligned with the locking pin permits extension and contraction of said link.

29. The adjusting link of claim 28, wherein the adjusting bolt further includes a retention flange on the end within the hub that prevents total withdrawal of the adjusting bolt from the hub by engaging the locking pin when the adjusting pin is fully extended relative to the hub.

30. The adjusting link of claim 29, wherein the tolerances between the adjusting bolt and the hub allow bind-free relative movement therebetween after extensive usage and in the presence of minor contamination.

31. A hatch cover lock mechanism for locking a hatch cover in pressure sealed relation to a hatch of a compartment on a railroad hopper car which comprises:

a locking arm connected to the hatch cover, said arm having a hinge end extending from one side of the cover and a latch end extending from the other side of the cover, said latch end of said arm including an upwardly extending substantially unidirectional locking slot, a hinge connected to said hinge end of the arm and pivotally connected to the car so that the cover may be pivoted between open and closed positions, a latch assembly at the latch end of the arm pivotally connected to the car and removably connectable to the arm to facilitate connecting/disconnecting of the assembly to the arm, said latch assembly including link means for adjusting the locked distance between the arm and the car and including a bolt adjustably received in a hub or shaft and pivotally connected to the car, whereby rotation of the hub approximately 180 degrees relative to the bolt unlocks the hub and permits longitudinal movement of the hub, and an overcenter toggle lever connected to the link means for removable engagement with the upwardly extending slot of said latch end of the arm and rotatable between locking and release positions for forcing the cover in pressure sealed relation to the hatch when in locked position, said lever including a locking pin engaging the locking slot and coacting with the lever when the lever is rotated to said release position to allow the cover to only partially open until the latch assembly is rotated to allow the assembly to be swung away from the latch end of the arm, thereby preventing the cover from explosively opening when the compartment is under high pressure.

32. In a substantially circular hatch cover for closing a circular hatch of a railroad hopper car wherein the hatch is defined by a coaming having an annular flange, the improvement in a gasket for the hatch cover that engages the coaming and seals against the passage of contaminants between the hatch cover and coaming, said gasket comprising:

an annular body of elastomeric material, and said body having therein a plurality of closed annular lumens filled with air at substantially atmospheric pressure wherein a cross section through one side of the body is substantially rectangular with substantially parallel top and bottom walls and substantially concave end walls.

33. The gasket of claim 32, wherein the gasket is symmetrically shaped so that the top or bottom wall may engage the cover to seal with the cover and the other of the top or bottom wall may engage the coaming flange to seal therewith.

34. The gasket of claim 33, wherein the top and bottom walls are substantially longer than the end walls.

35. The gasket of claim 34, wherein the elastomeric material is EPDM rubber.

36. The gasket of claim 35, wherein the elastomeric material is FDA approved EPDM rubber.

37. The gasket of claim 35, wherein the EPDM rubber is extruded.

38. A hatch cover lock mechanism for locking a hatch cover in pressure sealed relation to a hatch of a compartment on a railroad hopper car which comprises:

a locking arm connected to the hatch cover, said arm having a hinge end extending from one side of the cover and a latch end extending from the other side of the cover, said latch end of said arm including a substantially unidirectional locking slot extending outwardly therefrom, a hinge connected to said hinge end of the arm and pivotally connected to the car so that the cover may be pivoted between open and closed positions, a latch assembly at the latch end of the arm pivotally connected to the car and removably connectable to the arm to facilitate connecting/disconnecting the assembly to the arm for closing the cover in locked and sealed relation to the hatch and for freeing the latch assembly from the arm to allow the cover to fully open, said latch assembly including link means for adjusting the locked distance between the arm and the car, said link means pivotally mounted at one end to a shaft carried by the car and including a bolt adjustably received in a hub or shaft and pivotally connected to the car, whereby rotation of the hub approximately 180 degrees relative to the bolt unlocks the hub and permits longitudinal movement of the hub, an overcenter toggle lever pivotally mounted on a shaft carried at the other end of the link means, said lever including a locking pin engaging the locking slot of said arm and coacting with the lever to be in overcenter position relative to the axes of the shafts of the link means when the lever is swung into locked position against the cover so that upward pressure on the cover will tighten the engagement of the lever with the cover.

39. A vented hatch cover for covering a hatch opening of a compartment defined by a continuous coaming, said vented hatch cover comprising:

a first member including a first body, a gasket disposed adjacent to the first body to form a seal with the coaming, a plurality of inner and outer first protrusions extending from the first body, and at least one opening in the first body which allows air to enter the compartment, a second member including a second body of similar but slightly larger outer configuration than said first body and spanning said first body, a plurality of inner and outer second protrusions extending from the second body toward said first body, and means on one of said bodies for spacing said bodies in spaced relation, said first protrusions and said second protrusions coacting with said bodies to define a plurality of circuitous air passageways between the first and second members which facilitate the flow of air into and out of the compartment while inhibiting contaminants from entering the compartment, whereby the arrangement of the protrusions tends to alter the speed of the air traveling between the first and second members to prevent contaminants and moisture from entering the compartment.

40. A vented hatch cover for covering a hatch opening of a compartment defined by a coaming, said vented hatch cover comprising:

a first member having means for forming a seal with said coaming, a second member spanning said first member and being in supported spaced apart relation to said first member, at least one of said first and second members having means for defining a plurality of circuitous air passageways between said first and second members which allow air to be drawn into the compartment while preventing moisture and other contaminants from entering the compartment, wherein the first member includes a first substantially rigid body and first protrusions extending from said body, and the second member includes a second substantially rigid body having second protrusions extending therefrom and toward said first body, said first and second protrusions coacting with said bodies to define said plurality of air passageways, wherein the second member is substantially dome-shaped.

41. The vented hatch cover of claim 40, wherein the second member includes at least one locking arm slot formed in the second body for receiving a locking arm which is adapted to secure the vented hatch cover to the hatch.

42. The vented hatch cover of claim 41, wherein the first member includes at least one alignment slot for receiving the locking arm slot of the second member to facilitate alignment of the first and second members.

43. The vented hatch cover of claim 42, wherein the supporting means includes a plurality of legs extending from the second body to engage the first body of the first member.

44. The vented hatch cover of claim 43, wherein the supporting means further includes a plurality of shoulders extending from the first protrusions to engage the second body of the second member.

45. A vented hatch cover for covering a hatch opening of a compartment defined by a coaming, said vented hatch cover comprising:

a first member having means for forming a seal with said coaming, a second member spanning said first member and being in supported spaced apart relation to said first member, at least one of said first and second members having means for defining a plurality of circuitous air passageways between said first and second members which allow air to be drawn into the compartment while preventing moisture and other contaminants from entering the compartment, wherein the first member includes a first substantially rigid body and first protrusions extending from said body, and the second member includes a second substantially rigid body having second protrusions extending therefrom and toward said first body, said first and second protrusions coacting with said bodies to define said plurality of air passageways, said cover further including filter means for trapping contaminants suspended in the air which flows through the vented hatch cover, and said filter means including a filter attached to the first body of the first member.

46. A vented hatch cover assembly for covering a hatch having an opening in a compartment defined by a coaming, said assembly comprising:

a bottom member covering the hatch and having means for forming a seal with said coaming and at least one opening for allowing air to enter said compartment through said bottom member, a filter assembly attached to the bottom member adjacent to the at least one opening which prevents contaminants from entering the compartment, a top member spanning said bottom member and engageable with said bottom member in spaced apart relation therewith, at least one of said top and bottom members having protrusion means extending toward the other of said members and spaced therefrom for defining a plurality of air passageways between said top and bottom members which allows air to be drawn into the compartment from the atmosphere, means for securing said top member to said bottom member, and means for securing said cover assembly to said hatch, whereby the compartment is vented without opening the hatch.

47. The vented hatch cover assembly of claim 46, wherein the filter assembly includes a retainer member for maintaining a mesh filter adjacent to the at least one opening in the bottom member.

48. A vented hatch cover assembly for covering a hatch having an opening in a compartment defined by a coaming, said assembly comprising:

a bottom member covering the hatch and having means for forming a seal with said coaming and at least one opening for allowing air to enter said compartment through said bottom member, a top member spanning said bottom member and engageable with said bottom member in spaced apart relation therewith, at least one of said top and bottom members having protrusion means extending toward the other of said members and spaced therefrom for defining a plurality of air passageways between said top and bottom members which allows air to be drawn into the compartment from the atmosphere, means for securing said top member to said bottom member, and means for securing said cover assembly to said hatch, said means for securing said cover assembly to said hatch including a locking arm connected to the cover assembly and pivotally attached to one side of the hatch and releasably secured to the opposite side of the hatch by an adjustable locking assembly, whereby the compartment is vented without opening the hatch.

49. The vented hatch cover assembly of claim 48, wherein the adjustable locking assembly includes an adjusting bolt mounted to the hatch, a hub adjustably connectible to the adjusting bolt, a clevis fixedly attached to the adjusting hub, and an overcenter toggle locking/releasing lever pivotally connected to the clevis and engageable with the locking arm, whereby the assembly may be quickly and easily adjusted to provide a sealing relation between the cover and the hatch coaming.

50. A vented hatch cover for covering the hatch opening of a compartment defined by a coaming, said vented hatch cover comprising:

a first member having means for forming a seal with said coaming, a second member spanning said first member and being in supported spaced apart relation to said first member, at least one of said first and second members having means for defining a plurality of circuitous air passageways between said first and second members which allow air to be drawn into the compartment while preventing moisture and other contaminants from entering the compartment, said first member including a first substantially rigid body and first protrusions extending from said body thereof, and said second member including a substantially rigid body having second protrusions extending therefrom and toward first body, said first and second protrusions coacting with said bodies to define said plurality of air passageways, said first and second members being divided into multiple quadrants which define said circuitous air passageways, each quadrant including an opening in the first body of the first member which allows the air to enter the compartment, ridge means in each quadrant extending adjacent to said opening for preventing water on the first body of the first member from entering the compartment through the opening, said first member including inner and outer first protrusions arranged in each quadrant, said second member including inner and outer second protrusions arranged in each quadrant, said inner and outer first protrusions being substantially straight and arranged between the inner and outer second protrusions, and said inner and outer first protrusions each including an angled baffle member arranged between two substantially straight protrusions.

51. The vented hatch cover of claim 50, wherein the inner and outer second protrusions each include a pair of spaced apart arcuate shaped protrusions.

* * * * *